United States Patent [19]

Glandt et al.

[11] Patent Number: 4,926,941

[45] Date of Patent: May 22, 1990

[54] METHOD OF PRODUCING TAR SAND DEPOSITS CONTAINING CONDUCTIVE LAYERS

[75] Inventors: Carlos A. Glandt; Harold J. Vinegar; Michael Prats, all of Houston, Tex.

[73] Assignee: Shell Oil Company, Houston, Tex.

[21] Appl. No.: 419,172

[22] Filed: Oct. 10, 1989

[51] Int. Cl.[5] ..... E21B 43/24

[52] U.S. Cl. ..... 166/248; 166/60; 166/245; 166/272

[58] Field of Search ..... 166/245, 248, 250, 272, 166/302, 303, 60, 65.1

[56] References Cited

U.S. PATENT DOCUMENTS

| | | | |
|---|---|---|---|
| Re. 30,738 | 9/1981 | Bridges et al. | 166/248 |
| 3,848,671 | 11/1974 | Kern | 166/248 |
| 3,862,662 | 1/1975 | Kern | 166/248 |
| 3,946,809 | 3/1976 | Hagedorn | 166/248 |
| 3,958,636 | 5/1976 | Perkins | 166/248 |
| 3,986,557 | 10/1976 | Striegler et al. | 166/50 X |
| 3,994,340 | 11/1976 | Anderson et al. | 166/50 X |
| 4,037,658 | 7/1977 | Anderson | 166/272 |
| 4,084,637 | 4/1978 | Todd | 166/248 X |
| 4,228,853 | 10/1980 | Harvey et al. | 166/248 |
| 4,456,065 | 6/1984 | Heim et al. | 166/248 |
| 4,545,435 | 10/1985 | Bridges et al. | 166/60 X |
| 4,612,988 | 9/1986 | Segalman | 166/248 |
| 4,705,108 | 11/1987 | Little et al. | 166/248 |

*Primary Examiner*—George A. Suchfield

[57] ABSTRACT

A method is disclosed for producing thick tar sand deposits by preheating of thin, relatively conductive layers which are a small fraction of the total thickness of a tar sand deposit. The thin conductive layers serve to confine the heating within the tar sands to a thin zone adjacent to the conductive layers even for large distances between rows of electrodes. The preheating is continued until the viscosity of the tar in a thin preheated zone adjacent to the conductive layers is reduced sufficiently to allow steam injection into the tar sand deposit. The entire deposit is then produced by steam flooding.

9 Claims, 4 Drawing Sheets

METHOD OF PRODUCING TAR SAND DEPOSITS CONTAINING CONDUCTIVE LAYERS

BACKGROUND OF THE INVENTION

This invention relates to the production of hydrocarbons from earth formations, and more particularly, to those hydrocarbon-bearing deposits where the oil viscosity and saturation are so high that insufficient steam injectivity can be obtained by current steam injection methods.

A very large resource of heavy oil and tar sands exists in the world, such as those in Alberta, Canada; Utah and California in the United States; the Orinoco Belt of Venezuela; and the USSR. The total world reserve of tar sand deposits is estimated to be 2,100 billion barrels of oil, of which about 980 billion are located in Alberta, Canada, and of which 18 billion barrels of oil are present in shallow deposits in the United States.

In the present art, heavy oil deposits are produced by steam injection to swell and lower the viscosity of the crude to the point where it can be pushed toward the production wells. If steam injectivity is high enough, this is a very efficient means of heating and producing the formation. However, a large number of reservoirs contain tar of sufficiently high viscosity and saturation that initial steam injectivity is severely limited, so that even with a number of "huff-and-puff" pressure cycles, very little steam can be injected into the deposit without exceeding the formation fracturing pressure. Most of these tar sand deposits have previously not been capable of economic production.

The most difficult problem in steamflooding deposits with low injectivity is establishing and maintaining a flow channel between injection and production wells. Several proposals have been made to provide horizontal wells or conduits within a tar sand deposit to deliver hot fluids such as steam into the deposit, thereby heating and reducing the viscosity of the bitumen in tar sands adjacent to the horizontal well or conduit. U.S. Pat. No. 3,986,557 discloses use of such a conduit with a perforated section to allow entry of steam into, and drainage of mobilized tar out of, the tar sand deposit. U.S. Pat. Nos. 3,994,340 and 4,037,658 disclose use of such conduits or wells simply to heat an adjacent portion of deposit, thereby allowing injection of steam into the mobilized portions of the tar sand deposit.

In an attempt to overcome the steam injectivity problem, several proposals have been made for various means of electrical or electromagnetic heating of tar sands. One category of such proposals has involved the placement of electrodes in conventional injection and production wells between which an electric current is passed to heat the formation and mobilize the tar. This concept is disclosed in U.S. Pat. Nos. 3,848,671 and 3,958,636. A similar concept has been presented by Towson at the Second International Conference on Heavy Crude and Tar Sand (UNITAR/UNDP Information Center, Caracas, Venezuela, September, 1982). A novel variation, employing aquifers above and below a viscous hydrocarbon-bearing formation, is disclosed in U.S. Pat. No. 4,612,988. In U.S. Reissue Pat. No. 30738, Bridges and Taflove disclose a system and method for in-situ heat processing of hydrocarbonaceous earth formations utilizing a plurality of elongated electrodes inserted in the formation and bounding a particular volume of a formation. A radio frequency electrical field is used to dielectrically heat the deposit.

The electrode array is designed to generate uniform controlled heating throughout the bounded volume.

In U.S. Pat. No. 4,545,435, Bridges and Taflove again disclose a waveguide structure bounding a particular volume of earth formation. The waveguide is formed of rows of elongated electrodes in a "dense array" defined such that the spacing between rows is greater than the distance between electrodes in a row. In order to prevent vaporization of water at the electrodes, at least two adjacent rows of electrodes are kept at the same potential. The block of the formation between these equipotential rows is not heated electrically and acts as a heat sink for the electrodes. Electrical power is supplied at a relatively low frequency (60 Hz or below) and heating is by electric conduction rather than dielectric displacement currents. The temperature at the electrodes is controlled below the vaporization point of water to maintain an electrically conducting path between the electrodes and the formation. Again, the "dense array" of electrodes is designed to generate relatively uniform heating throughout the bounded volume.

Hiebert et al ("Numerical Simulation Results for the Electrical Heating of Athabasca Oil Sand Formations," Reservoir Engineering Journal, Society of Petroleum Engineers, January, 1986) focus on the effect of electrode placement on the electric heating process. They depict the oil or tar sand as a highly resistive material interspersed with conductive water sands and shale layers. Hiebert et al propose to use the adjacent cap and base rocks (relatively thick, conductive water sands and shales) as an extended electrode sandwich to uniformly heat the oil sand formation from above and below.

As can be seen from these examples, previous proposals have concentrated on achieving substantially uniform heating in a block of a formation so as to avoid overheating selected intervals. The common conception is that it is wasteful and uneconomic to generate nonuniform electric heating in the deposit. The electrode array utilized by prior inventors therefore bounds a particular volume of earth formation in order to achieve this uniform heating. However the process of uniformly heating a block of tar sands by electrical means is extremely uneconomic. Since conversion of fossil fuel energy to electrical power is only about 38 percent efficient, a significant energy loss occurs in heating an entire tar sand deposit with electrical energy.

We have discovered an economic method of selective heating particularly applicable to thick tar sand deposits containing thin, high conductivity layers. These thin conductive layers are typically shales into which the tar sand was alluvially deposited, but may also be water sands with or without salinity variations, or layers which also contain hydrocarbons but have significantly greater porosity. A thin conductive layer is heated to a temperature that is sufficient to form an adjacent thin preheated zone, in which the viscosity of the tar is reduced to a level sufficient to allow steam injection into the thin preheated zone. Electrical heating is then discontinued, and the deposit is steam flooded. The thin conductive layers to be heated are preferably in the lower portion of the tar sand deposit, and the electrically heated zones are typically only a small fraction of the total tar sand deposit. This localized heating generates a uniformly heated plane (the shale layer) within the tar sand deposit.

It is therefore an object of this invention to provide an efficient and economic method of in-situ heat processing of tar sand and other heavy oil deposits wherein electrical current is used to heat thin, highly conductive layers within such deposits, utilizing a minimum of electrical energy to prepare the tar sands for steam injection; and then to efficiently utilize steam injection to mobilize and recover a substantial portion of the heavy oil and tar contained in the deposit.

SUMMARY OF THE INVENTION

This invention is particularly applicable to deposits of heavy oil, such as tar sands, which contain thin conductive layers. These thin conductive layers will typically be shale layers interspersed within the tar sand deposit, but may also be water sands (with or without salinity differentials), or layers which also contain hydrocarbons but have significantly greater porosity. For geological reasons, shale layers are almost always found within a tar sand deposit because the tar sands were deposited as alluvial fill within the shale. The shales have conductivities of from about 0.2 to about 0.5 mho/m, while the tar sands have conductivities of about 0.02 to 0.05 mho/m. Consequently, conductivity ratios between the shales and the tar sands range from about 10:1 to about 100:1, and a typical conductivity ratio is about 20:1. The conductive layers chosen for electrical heating are preferably near the bottom of the deposit, so that the steam injected can rise through the deposit and heated oil can drain downwards into the flowing steam channel. The thin conductive layers to be heated are additionally selected to provide lateral continuity of conductivity within the shale layer, and to provide a substantially higher conductivity, for a given thickness, than the surrounding tar sands. Thin conductive layers selected on this basis will substantially confine the heat generation within and around the conductive layers and allow much greater spacing between rows of electrodes.

Low-frequency electrical power (preferably at 60 Hz or below) is used to heat the thin conductive layers in a heavy oil or tar sand deposit. Electrodes are installed in wells spaced in parallel rows, and electrodes within a row may be energized from a common voltage source. The electrodes within a row form a plane of electrodes in the formation. The spacing between electrodes in the row, spacing between the rows, and diameter of the electrode are selected to prevent overheating (vaporization of water) at the electrodes.

The active length of the electrode electrically spanning the thin conductive layer varies from about equal to the thickness of the thin conductive layer to be heated, to as much as about three times the thickness of the conductive layer. Thus the electrodes do not make electrical contact with the formation over the major thickness of the tar sand deposit, which improves the vertical confinement of the electrical current flow.

As the thin conductive layers are electrically heated, the conductivity of the layers will increase. This concentrates heating in those layers. In fact, for shallow deposits the conductivity may increase by as much as a factor of three when the temperature of the deposit increases from 20° C. to 100° C. For deeper deposits, where the water vaporization temperature is higher due to increased fluid pressure, the increase in conductivity can be even greater. As a result, the thin conductive layers heat rapidly, with relatively little electric heating of the majority of the tar sand deposit. The tar sands adjacent to the thin conductive layers are then heated by thermal conduction from :he electrically heated shale layers in a period of a few years, forming a thin preheated zone immediately adjacent to each thin conductive layer. As a result of preheating, the viscosity of the tar in the preheated zone is reduced, and therefore the preheated zone has increased injectivity. The total preheating phase is completed in a relatively short period of time, preferably no more than about two years, and is then followed by injection of steam and/or other fluids.

A pattern of steam injection and production wells is installed in the tar sand deposit. The production wells are preferably located within the electrode planes, where oil mobility after the preheating phase will be highest. Additionally, within the electrode planes, the production wells are drilled as close as possible to the electrode wells to minimize potential differences which could lead to ground currents. Preferably, some of the electrode wells themselves are used as the production wells, once the electrical stimulation is terminated. The steam injection wells are located midway between the electrode rows because this is the coldest location in the patterns after electrical stimulation.

The subsequent steam injection phase begins with continuous steam injection within the thin preheated zone and adjacent to the conductive shale layer where the tar viscosity is lowest. Steam is initially injected adjacent to a shale layer and within the preheated zone. The heated oil progressively drains downwards within the deposit, allowing the steam to rise within the deposit. The steam flowing into the tar sand deposit effectively displaces oil toward the production wells. The steam injection and recovery phase of the process may take a number of years to complete.

DETAILED DESCRIPTION OF THE INVENTION

Figure 1:
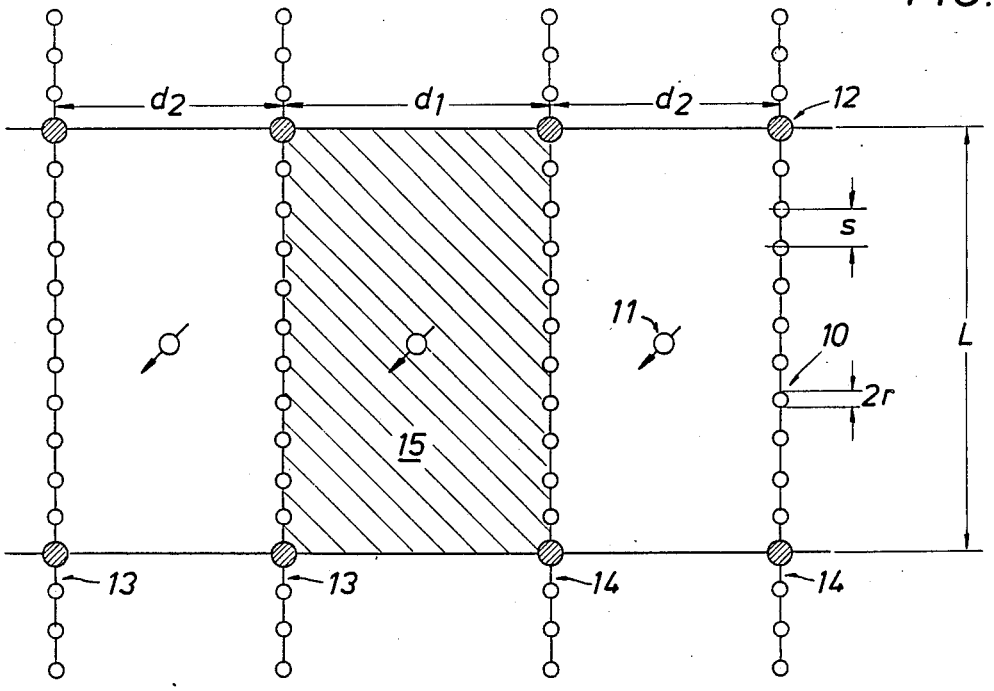
FIG. 1 is a plan view of a well pattern for electrode wells for heating a tar sand deposit, and steam injection and production wells for recovering hydrocarbons from the deposit.

Referring now to FIG. 1 there is shown a well pattern for producing heavy oil and tar sand deposits utilizing an array of vertical electrodes 10, steam injection wells 11, and production wells 12.

The electrodes are located in parallel rows, with a spacing s between electrodes in a row. Rows are designated either as ground rows 13 or excited rows 14, depending on whether they are at ground potential or high voltage, respectively. The ground and excited rows repeat throughout the field in the pattern shown. This type of electrode pattern allows economic heat injection rates while preventing vaporization of water at the electrodes. A ground row adjacent to an excited row is separated by a distance $d_1$. A ground row adjacent to a ground row, and an excited row adjacent to an excited row, are separated by a distance $d_2$. In the alternative, the pattern could consist of pairs of rows of positively excited and negatively excited electrodes (out of phase) rather than pairs of rows of ground and energized electrodes. The electrodes in adjacent rows are not necessarily on line with each other, as described below.

In a typical embodiment, each electrode may have a radius r of one foot, the spacing between electrodes in a row s may be 45 feet, and the inter-row distance between a ground row and an excited row $d_1$ may be 300 feet, and the distance between rows at the same potential $d_2$ may be 120 to 300 feet. There are sufficient electrodes within each row that the row length L between productIon wells is many tImes the inter-row distance $d_1$ or $d_2$. For example, there may be 100 electrodes along the row, such that the row length is 4500 feet, which is much greater than the inter-row spacing of 120–300 feet.

Also shown in FIG. 1 is the pattern of the steam injection wells 11 and production wells 12. Production wells may be drilled in the electrode row planes prior to energizing the electrodes to prevent contact with stray electrical currents. In the excited row planes, the production well casing should be electrically insulated from the surrounding formation. As an alternative, the production wells may be drilled after the electric preheating phase, in which case electrical insulation would not be required. The steam injection wells are located midway between the rows of electrodes, because this will be the coldest location in the pattern and will therefore benefit most from the steam injection, and also midway between the production wells in an inverted five spot pattern 15.

Figure 2:
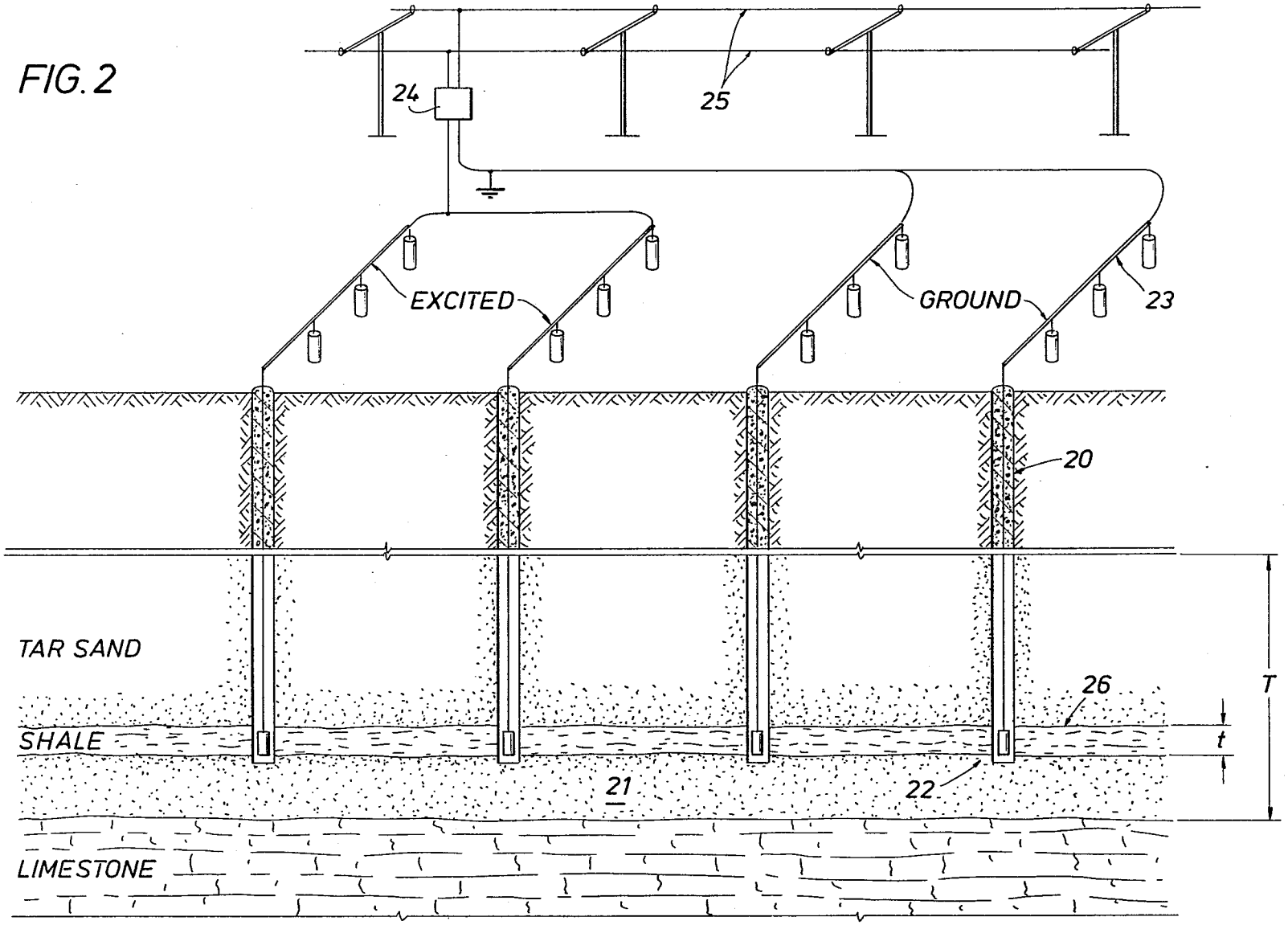
FIG. 2 is a cross-sectional view through the deposit in a plane coincident with an electrode row.

Referring now to FIG. 2, the electrodes are placed in drill holes 20 drilled from the surface into a tar sand deposit 21. The electrodes 22 are energized from a low-frequency source at about 60 Hz or below by means of a common electrical bus line 23 which may connect, for example, to a transformer 24, a power conditioner (not shown) or directly to a power line 25. Surface facilities (not shown) are also provided for monitoring current, voltage, and power to each electrode well. The electrodes are placed within the deposit such that they span a thin, conductive zone 26, and have an active area in contact with the formation substantially only over the thickness t of the thin conductive layer to be heated. The thin layer can be, for example, a shale zone of $t=10$ feet in a total tar sand deposit thickness T of, for example, $T=150$ feet. The active length of an electrode in this example would be from about the same length as the thickness of the thin layer t to two or three times that length. The tar sand deposit may contain several thin conductive layers, interspersed between the tar sand layers. It may be preferable for electrodes to contact as many highly conductive thin layers as are necessary to heat tar sand layers into which steam will subsequently be injected. Thus, any electrode may contain more than one active length.

Figure 3:
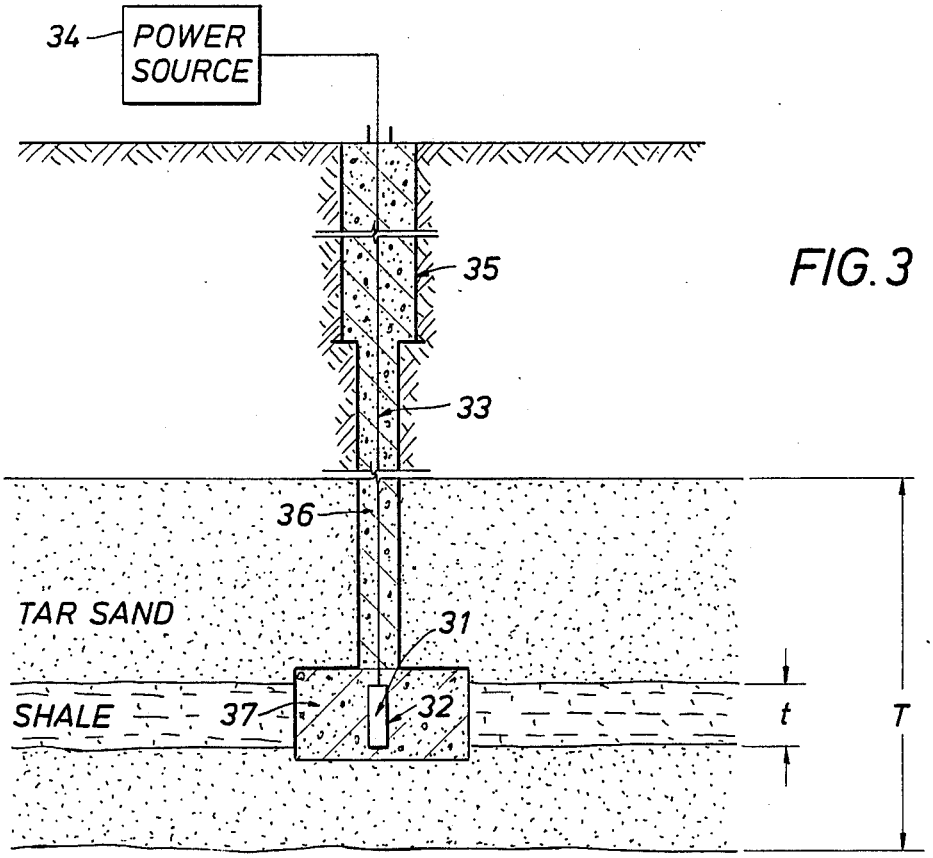
FIG. 3 is a cross-sectional view of an electrode well.

Referring now to FIG. 3, the electrodes 31 are constructed from a material which is a good conductor, such as aluminum or copper, and may be clad with stainless steel 32 for strength and corrosion resistance where contact is made with the formation. A conducting cable 33 connects the electrode with the power source 34 at the surface. The cable may or may not be insulated, but should be constructed of a non-ferromagnetic conductor such as copper or aluminum to reduce magnetic hysteresis losses in the cable. The electrode well may require surface casing 35 which is cemented to below the aquifer. A non-conducting cement 36 seals a majority of the length of the drill hole. The drill hole is enlarged at the bottom section adjacent to the thin layer by underreaming the formation. In this underreamed section, the electrode makes electrical contact with the tar sand deposit through an electrically conductive material 37, for example, electrically conductive Portland cement with high salt content or graphite filler, aluminum-filled electrically conductive epoxy, or saturated brine electrolyte, which serves to physically enlarge the effective diameter of the electrode and reduce overheating. As another alternative, the conductive cement between the electrode and the formation may be filled with metal filler to further improve conductivity. In still another alternative, the electrode may include metal fins, coiled wire, or coiled foil which may be extended when the electrode is placed in the underreamed portion of the drill hole. The effective conductivity of the electrically conductive section should be substantially greater than that of the adjacent deposit layers to reduce local heating at the electrode.

Figure 4:
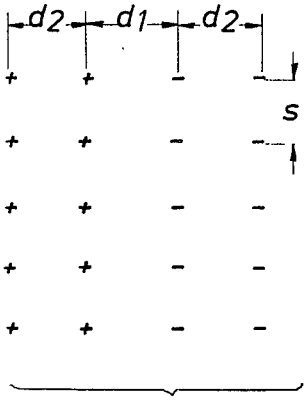
FIG. 4 shows a direct line drive electrode array.
Figure 5:
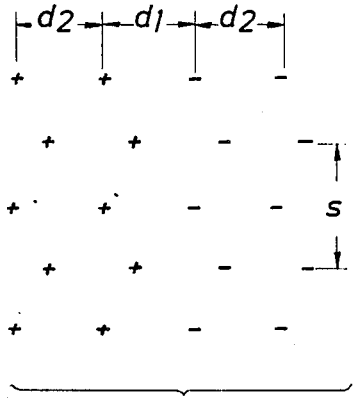
FIG. 5 shows a sawtooth line drive electrode array.
Figure 6:
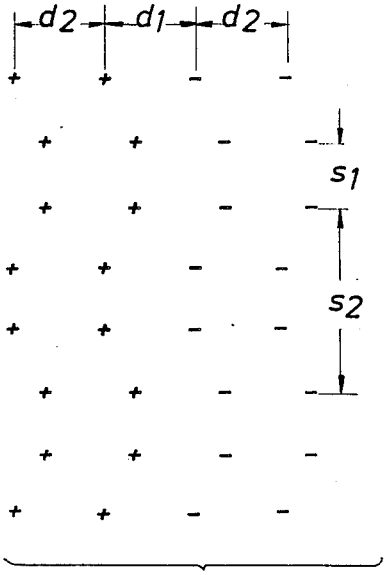
FIG. 6 shows a pair offset line drive electrode array.

The electrode well pattern will be determined by an economic optimum which depends, in turn, on the cost of the electrode wells and the conductivity ratio between the thin conductive layer and the bulk of the tar sand deposit. Electrode configurations other than the line array can be employed. FIGS. 4–6 show some possible arrays in which alternate electrodes or pairs of electrodes are offset in a regular pattern. FIG. 4 shows the direct line drive, FIG. 5 the sawtooth line drive, and FIG. 6 the pair offset line drive electrode arrays. In this last array, there are two interelectrode distances within a row $s_1$ and $s_2$. The patterns show both positively excited electrodes (+) and negatively excited electrodes (−).

The thin conductive layers are preferably near the bottom of a thick segment of tar sand deposit, so that steam can rise up through the deposit and heated oil can drain down into the flowing steam channel. The thin conductive layers to be heated are additionally selected, on the basis of resistivity well logs, to provide lateral continuity of conductivity. The layers are also selected to provide a substantially higher conductivity-thickness product than surrounding zones in the deposit, where the conductivity-thickness product is defined as, for example, the product of the electrical conductivity for a thin layer ($C_{tl}$) and the thickness of that layer (t), or the electrical conductivity of a tar sand deposit ($C_{ts}$) and the thickness of that deposit (T−t). The conductivity-thickness product for a thin layer ($C_{tl}t$) is compared with the conductivity-thickness product for adjacent tar sand layers of thickness T−t ($C_{ts}(T-t)$). By selectively heating a thin layer with a higher conductivity-thickness product ($C_{tl}t$) than that of the tar sand layer ($C_{ts}(T-t)$), the heat generated within the thin layer is more effectively confIned to that thin layer. This is possible because in a tar sand deposit the shale is more conductive than the tar sand, and may be, for example, 20 times more conductive.

The amount of electrical power generated in a volume of material, such as a subterranean, hydrocarbon-bearing deposit, is given by the expression:

$$P=CE^2$$

where P is the power generated, C is the conductivity, and E is the electric field intensity. For constant potential boundary conditions, such as those maintained at the electrodes, the electric field distribution is set by the geometry of the electrode array. The heating is then determined by the conductivity distribution of the deposit. The more conductive layers in the deposit will heat more rapidly. Moreover, as the temperature of a layer rises, the conductivity of that layer increases, so that the conductive layers will absorb heat still more rapidly than the surrounding layers. This continues until vaporization of water occurs in the conductive layer, at which time its conductivity will decrease as steam evolves from the conductive layer. Consequently, it is preferred to keep the temperature within the conductive layer below the point at which steam will evolve.

During the electrical preheating step, surface measurements are made of the current flow into each electrode. All the electrodes in a row are energized from a common voltage source, so that as the thin conductive layers heat and become more conductive, the current will steadily increase. Measurements of the current entering the electrodes can be used to monitor the progress of the preheating process. The electrode current will increase steadily until vaporization of water occurs either at the electrode or deeper within the deposit, at which time a drop in current will be observed. Additionally, temperature monitoring wells and/or numerical simulations may be used to determine the optimum time to commence steam injection. The preheating phase should be completed within a time period of a few years. In this time, thermal conduction will establish relatively uniform heating in a thin, preheated zone adjacent to the thin conductive layers.

Once the preheating phase is completed, the tar sand deposit is steam flooded to recover hydrocarbons present. Fluids other than steam, such as hot air or other gases, or hot water, may also be used to mobilize the hydrocarbons, and/or to drive the hydrocarbons to production wells.

EXAMPLE

Numerical simulations were used to evaluate the feasibility of electrically preheating a thin, conductive layer within a tar sand deposit, and subsequently injecting steam. The numerical simulations required an input function of electrical conductivity versus temperature. The change in electrical conductivity of a typical Athabasca tar sand with temperature may be described by the equation:

$$\frac{C}{T+22^\circ} = \text{constant}$$

where C is the electrical conductivity and T is the temperature in degrees Centigrade. Thus there is an increase in conductivity by about a factor of three as the temperature rises from 20° C. (T+22°=42°) to 100° C. (T+22°=122°). These simulations also required an input function of viscosity versus temperature. The change in viscosity versus temperature for a typical Athabasca tar sand bitumen may be described by the equation:

$$\mu=[\exp(3.218\times10^{11})(T^{-4.2})]-0.5$$

where T is in degrees Kelvin and viscosity ($\mu$) is in centipoise (cp): For example, the viscosity at 20° C. is about 1.6 million cp, whereas the viscosity at 100° C. is reduced to about 180 cp. In a sand with a permeability of 3 darcy, steam at typical field conditions can be injected continuously once the viscosity of the tar is reduced to about 10,000 cp, which occurs at a temperature of about 50° C. Injection at a somewhat higher viscosity, for example at about 15,000 cp, may be possible if the higher viscosity is localized. Also, where initial injectivity is limited, a few "huff-and-puff" steam injection cycles may be sufficient to overcome localized high viscosity.

The parameters set for the electric preheating numerical simulation are shown in Table 1. Two cases are identified, Case 1, a tar sand deposit with no shale layer, and Case 2, a tar sand deposit including a shale layer. Most parameters were held constant between the two cases. The total amount of heat delivered to the formation was set at five billion BTU per electrode pair, delivered over a two-year period. Because of the greater conductivity of the shale layer, relative to the tar sand deposit, a lower voltage was required to inject the same amount of heat for the electrodes in Case 2.

TABLE 1

ELECTRIC PREHEATING NUMERICAL SIMULATION

| Parameter | Case 1 No Shale Layer | Case 2 One Shale Layer |
|---|---|---|
| Deposit thickness, ft | | |
| tar sand deposit (T) | 100 | 100 |
| shale layer (t) | N/A | 10 |
| overburden (shale) | 210 | 210 |
| underburden (limestone) | 210 | 210 |
| Volumetric heat capacity, BTU/ft$^3$-°F. | 40 | 40 |
| Thermal conductivity, BTU/day-°F.-ft | 37.2 | 37.2 |
| Electric conductivity, mhos/m | | |
| tar sand deposit | 0.01 | 0.01 |
| shale layer | N/A | 0.2 |
| overburden (shale) | 0.2 | 0.2 |
| underburden (limestone) | 0.01 | 0.01 |
| Interrow distance, ft | | |
| same polarity ($d_2$) | 150 | 150 |
| opposite polarity ($d_1$) | 330 | 330 |
| Interelectrode distance, ft (s) | 45 | 45 |
| Active electrode length, ft | 30 | 30 |
| Electrode radius, in. | 12 | 12 |
| Total heat delivered, BTU/electrode pair | $6.0\times10^9$ | $6.0\times10^9$ |
| Electrode voltage, volts | 820 | 530 |
| Heating time, years | 2 | 2 |

Figure 7:
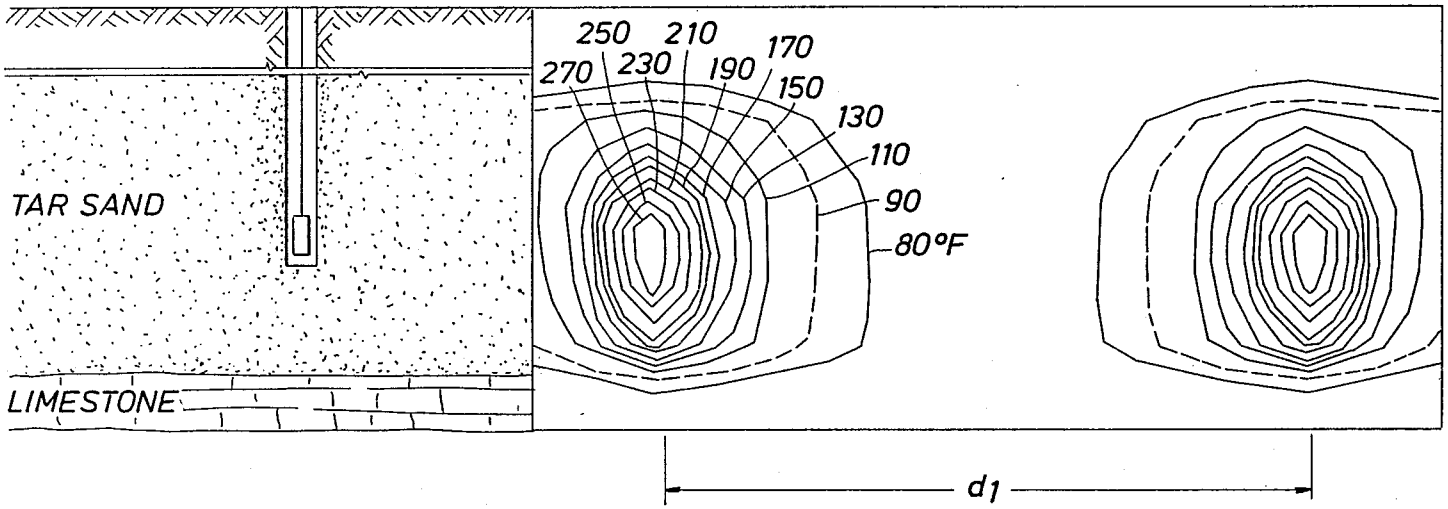
FIG. 7 shows a numerical simulation of the temperature distribution after electrically preheating a thick tar sand deposit with no shale layer.
Figure 8:
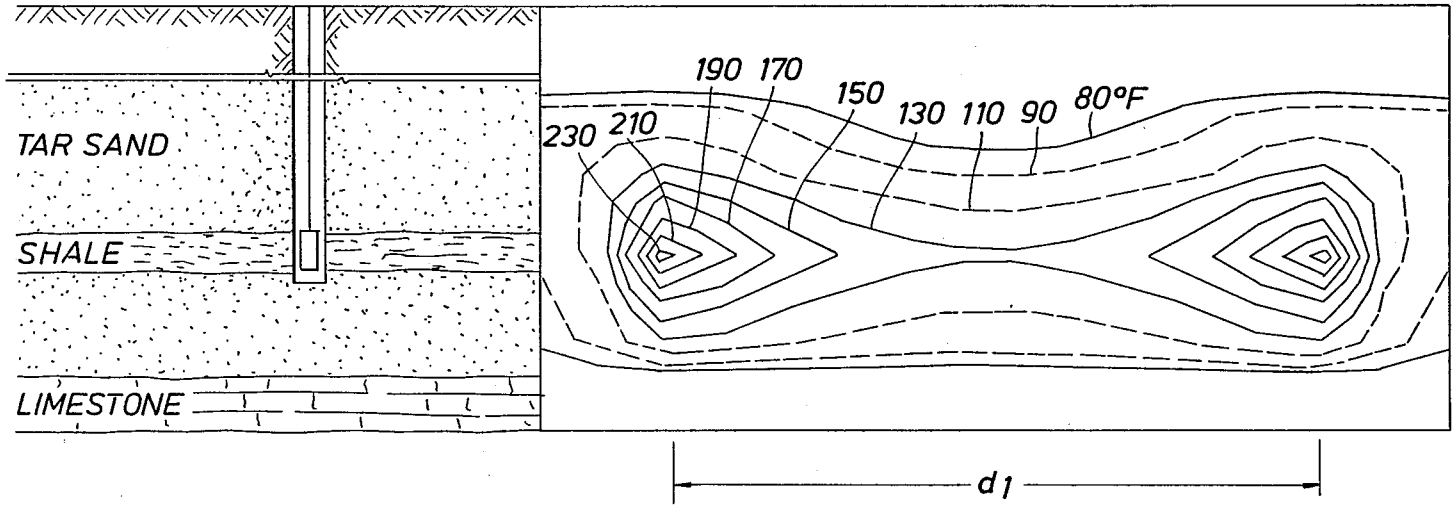
FIG. 8 shows a numerical simulation of the temperature distribution after electrically preheating a shale layer located within a thick tar sand deposit.

FIGS. 7 and 8 show the results of numerical simulations of the temperature distribution in a typical Athabasca tar sand deposit with the above conductivity functions. FIG. 7 shows the projected temperature distribution that resulted from simulated electrical preheating of a thick tar sand deposit with uniform conductivity and no shale layer. FIG. 8 shows the projected temperature distribution that resulted from simulated electrical preheating of a thick tar sand deposit with one 10-foot thick shale layer located 15 feet from the bottom of the deposit. The shale layer had an electrical conductivity 20 times that of the deposit, and the electrodes contacted the deposit from 10 feet above to 10 feet below the shale layer. The electrodes in both cases had an active length of 30 feet and were spaced 330 feet apart ($d_1$).

As shown in FIG. 8, the two-year period of preheating resulted in a contiguous preheated zone, between the electrodes, at a temperature and viscosity sufficient to allow steam injection at a point midway between the electrodes. Since the temperature of the contiguous preheated zone between the electrodes is shown as 80° to over 130° F., and steam injection may be possible at temperatures as low as about 120° F., a heating period of less than two years could have been sufficient for this example. For tar sands containing bitumen less viscous than the Athabasca example, even less intensive heating would be required to achieve a viscosity reduction sufficient to allow steam injection. However, as shown in FIG. 7, after injecting the same quantity of heat over the same two-year time period, no such contiguous zone is established in the tar sand deposit without a shale layer. The higher temperature, lower viscosity zones are localized around the electrodes, and it would not be possible to inject steam at a point midway between the electrodes. To achieve steam injectivity at that midway point without vaporizing water adjacent to the electrodes, it would be necessary to either heat the deposit over a longer time period or decrease the distance between the electrode rows ($d_1$ and $d_2$). Either of these steps would increase the overall cost of such a recovery process. It should be noted that once some portion of the deposit reaches the temperature at which any water within the deposit will vaporize, the conductivity of the deposit will significantly decrease.

Comparison of FIGS. 7 and 8 demonstrates that preheating a tar sand deposit containing a conductive shale layer establishes a thin preheated zone adjacent to the conductive layer, and allows steam injection after a shorter period of heating, and/or much greater distances between rows of electrodes, and therefore improved economics.

Figure 9:
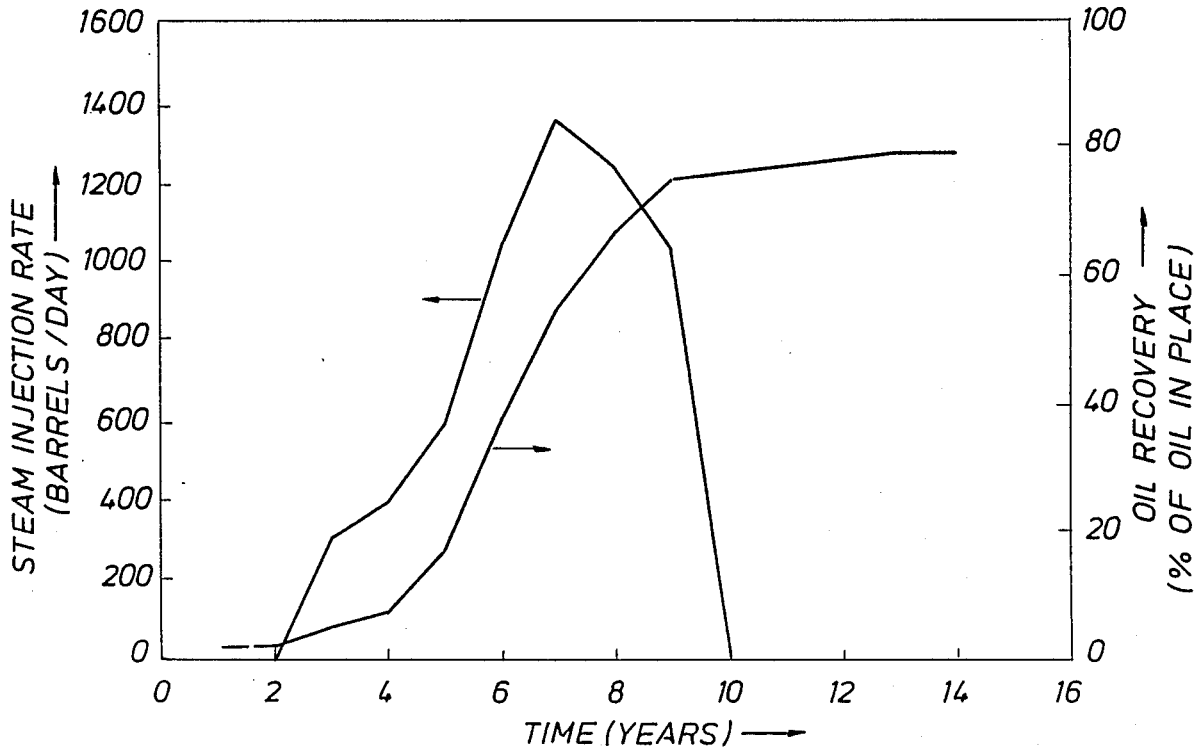
FIG. 9 shows a numerical simulation of steam injection and oil recovery rates following the electric preheating simulation shown in FIG. 8.

FIG. 9 shows the projected steam injection and oil production that would result after electrically preheating a thin conductive layer within the same Athabasca tar sand deposit with the above conductivity and viscosity functions. After the initial preheating phase of about two years, steam injection may be initiated, and steadily increased to a rate of about 1,400 barrels per day. After about seven years, live steam reaches the production well, and steam injection is reduced. At the completion of the recovery project, almost 80 percent of the hydrocarbon originally in place is recovered.

The oil recovery and steam injection rates for a five-acre pattern using the proposed process are more akin to conventional heavy oil developments than to tar sands with no steam injectivity. The total electrical energy utilized was less than 10 percent of the equivalent energy in steam utilized in producing the deposit, thus, the ratio of electrical energy to steam energy was very favorable. Also, the economics of the process are significantly improved relative to the prior art proposals of uniform electrical heating of an entire tar sand deposit.

Significant energy savings can be realized when the electrodes span a thin conductive layer such as a shale layer within a tar sand deposit. Preheating a thin conductive layer substantially confines the electrical current in the vertical direction, minimizes the amount of expensive electrical energy dissipated outside the tar sand deposit, and provides a thin preheated zone of reduced viscosity within the tar sand deposit that allows subsequent steam injection. Additionally, since much greater distances between rows of electrodes are possible, the capital cost of the recovery process is reduced relative to previous proposals.

Having discussed the invention with reference to certain of its preferred embodiments, it is pointed out that the embodiments discussed are illustrative rather than limiting in nature, and that many variations and modifications are possible within the scope of the invention. Many such variations and modifications may be considered obvious and desirable to those skilled in the art based upon a review of the figures and the foregoing description of preferred embodiments.

What is claimed is:

1. A process for recovering hydrocarbons from a hydrocarbon-bearing deposit, comprising:
   - selecting a hydrocarbon-bearing deposit which contains a thin conductive layer within the deposit;
   - installing electrodes spanning the thin conductive layer;
   - electrically heating the thin conductive layer to form a thin preheated zone immediately adjacent to the thin conductive layer;
   - providing wells for hot fluid injection into the deposit and hydrocarbon production from the deposit;
   - injecting a hot fluid into the deposit adjacent to the thin conductive layer and within the thin preheated zone to displace the hydrocarbons to the production wells; and
   - recovering hydrocarbons from the production wells.

2. The process of claim 1 in which the hot fluid is steam.

3. The process of claim 1 in which the hot fluid is water.

4. A process for recovering hydrocarbons from a hydrocarbon-bearing deposit, comprising:
   - selecting a hydrocarbon-bearing deposit which contains a thin conductive layer within the deposit;
   - installing electrodes spanning the thin conductive layer;
   - electrically heating the thin conductive layer to form a thin preheated zone immediately adjacent to the thin conductive layer;
   - providing wells for hot fluid injection on into the deposit and hydrocarbon production from the deposit;
   - injecting a hot fluid into the thin preheated zone to increase the injectivity of the thin preheated zone;
   - injecting a drive fluid into the deposit to drive the hydrocarbons to the production wells; and
   - recovering hydrocarbons from the production wells.

5. The process of claim 4 in which the hot fluid is steam.

6. The process of claim 4 in which the drive fluid is steam.

7. The process of claim 4 in which the drive fluid is hot water.

8. A process for recovering hydrocarbons from a hydrocarbon-bearing deposit, comprising:
   - selecting a hydrocarbon-bearing deposit which contains a thin conductive layer within the deposit;
   - installing electrodes spanning the thin conductive layer;
   - electrically heating the thin conductive layer to form a thin preheated zone immediately adjacent to the thin conductive layer;
   - providing wells for injection into the deposit and hydrocarbon production from the deposit;
   - injecting steam into the deposit adjacent to the thin conductive layer and within the thin preheated zone to drive the hydrocarbons to the production wells; and recovering hydrocarbons from the production wells.

9. A process for increasing the injectivity of a hydrocarbon-bearing deposit, comprising:

selecting a hydrocarbon-bearing deposit which contains a thin conductive layer within the deposit;

installing electrodes spanning the thin conductive layer;

electrically heating the thin conductive layer to form a thin preheated zone immediately adjacent to the thin conductive layer;

heating the thin preheated zone by thermal conduction to a temperature sufficient to allow injection of fluids into the thin preheated zone.

* * * * *